United States Patent [19]

Chamska et al.

[11] 4,302,300

[45] Nov. 24, 1981

[54] METHOD OF MANUFACTURE OF ABRASIVE TOOLS HAVING METAL GALVANIC BOND MATERIAL

[75] Inventors: Ludwika Chamska; Mieczysław Maciak; Stanisław Majewski; Miroslaw Omielczenko; Jerzy Pańczyk, all of Warsaw, Poland

[73] Assignee: Kombinat Przemyslu Narzedziowego "VIS", Warsaw, Poland

[21] Appl. No.: 178,944

[22] Filed: Aug. 15, 1980

[30] Foreign Application Priority Data

Aug. 25, 1979 [PL] Poland ..... 217945

[51] Int. Cl.[3] ..... C25D 15/00

[52] U.S. Cl. ..... 204/16; 204/23

[58] Field of Search ..... 204/16, 23

[56] References Cited

U.S. PATENT DOCUMENTS

| | | | |
|---|---|---|---|
| 3,061,525 | 10/1962 | Grazen | 204/16 |
| 3,205,624 | 9/1965 | Weiss | 204/16 |
| 3,488,892 | 1/1970 | Benner | 204/16 |
| 3,762,895 | 10/1973 | Keeleric | 51/309 |
| 3,957,593 | 5/1976 | Haack | 204/16 |
| 3,980,549 | 9/1976 | Grutza | 204/16 |

*Primary Examiner*—T. M. Tufariello

*Attorney, Agent, or Firm*—Haseltine and Lake

[57] ABSTRACT

A method of manufacture of abrasive tools having a metal galvanic binding material consists in coating the surface of the tool in an electroplating bath with a coat of a metal binding material together with particles of an abrasive material, and during electrolytic application of a coat of metal binding material the sizes of particles of the abrasive material are reduced by at least one, and preferably two, orders of magnitude in relation to the initial abrasive material.

6 Claims, No Drawings

METHOD OF MANUFACTURE OF ABRASIVE TOOLS HAVING METAL GALVANIC BOND MATERIAL

The invention refers to a method of manufacture of abrasive tools having a metal galvanic binding material.

In the known methods of manufacture of abrasive tools having a metal galvanic binding material, a metal coat is applied electrolytically onto the surface of the tool in the presence of abrasive particles adjoining this surface, and depending on the application of the tool particles of one nominal size are selected. Retention of the particles in the metal binding material depends mainly on the mechanical properties of the metal of the binding material. The type of metal of the binding material is restricted by technological properties as well as costs of the material.

The object of the invention is to increase the strength of the binding material.

The essence of the invention is a method of manufacture of abrasive tools having a metal galvanic binding material, wherein onto the surface of the body of the tool, which adjoins particles of the abrasive material, the metal of the binding material is applied electrolytically until said particles of the abrasive material are partially coated, and then the sizes of the particles of the abrasive material are changed by at least one, and preferably by two, orders of magnitude of the particle size in relation to the initial abrasive material.

The initial abrasive material consists of particles of diamond or of cubic boron nitride having a particle size from 63/50 up to 200/160 micrometers, which corresponds substantially to 230/270 to 70/80 mesh according to ASTM-E-11 and the abrasive material of reduced particle size is silicon carbide having a size from 0.5 up to 5 micrometers. In another case the initial abrasive material consists of particles of diamond or cubic boron nitride of the size from 63/50 up to 200/160 micrometers, and the abrasive material of reduced particle size consists of diamond microgrit having a particle size from 0.1 up to 20 micrometers. In still another case the initial abrasive material consists of particles of diamond or cubic boron nitride having a particle size from 63/50 up to 200/160 micrometers, and the abrasive material of reduced particle size consists of particles of aloxite having a particle size from 1 up to 60 micrometers. The duration of applying a coat of the metal binding material together with particles of the initial abrasive material is at least a half of the total duration of applying the metal binding material. The ratio of the duration of applying a coat of the metal binding material together with abrasive particles of a reduced particle size to the total duration of applying the metal binding material is preferably reduced when larger sizes of the initial abrasive material are selected. The coat of the metal binding material in the vicinity of the surface of the tool contains flexible pure metal which adheres well to said surface, which at a larger distance from the surface of the body of the tool contains more inclusions of a very fine abrasive material, this changing advantageously the mechanical properties of the binding material.

The invention is explained in the more detail in examples wherein Example 1 presents a method of making a circumferential grinding wheel, wherein the initial abrasive material consists of diamond particles, and the abrasive material of reduced particle size is silicon carbide, Example 2 presents a method of making a grinding pin wherein the initial abrasive material consists of particles of cubic boron nitride, and the abrasive material of reduced grain size consists of diamond microgrit, and Example 3 presents a method of making a grinding pin wherein the initial abrasive material consists of diamond particles, and the abrasive material of reduced particle size is aloxite.

Example 1

A method of making a circumferential grinding wheel, wherein the initial abrasive material consists of diamond particles, and the abrasive material of reduced particle size is silicon carbide. In an electrolytic tank filled with a nickel plating bath for the tool which acts as a cathode, the diamond particles having a size of 200/160 micrometers, which adjoin the surface of the tool, and an anode are immersed. On the surface of the tool and around the diamond particles a coat of the metal binding material is deposited a current density of 50 $A/m^2$ until partial covering of the diamond particles occur. Then, after obtaining the initial coat of the binding material, at current density of 150 $A/m^2$, the type and size of the abrasive particles is changed to silicon carbide particles having an average size of 3 micrometers, and further deposition of the coat of the binding material is carried out at the same current density. The ratio of the duration of producing the initial coat of the binding material and the duration of depositing the bond material after the change of the particle size is 8:1. Then, the tool is taken out from the bath, washed and dried.

Example 2

A method of making a grinding pin, wherein the initial abrasive material consists of particles of cubic boron nitride, and the abrasive material of reduced particle size consists of diamond microgrit.

In an electrolytic tank filled with a nickel plating bath for the grinding pin, particles of cubic boron nitride of having a particle of 100/80 micrometers, and nickel anodes are placed. On the working surface of the tool and around the particles which adjoin said surface a coat of the metal binding material having a thickness of about $\frac{1}{3}$ of the grain size is deposited at a current density of 25 $A/m^2$. Then, after obtaining the initial coat of the binding material, at a current density of 100 $A/m^2$ the abrasive particle size is changed to diamond microgrit having a particle size of 1–3 micrometers, and further deposition of the coat of the binding material is carried out at a current density of 25 $A/m^2$.

The ratio of the duration of producing the initial coat of the binding material and the duration of depositing the binding material after the change of the particle size is 4:1, and then the tool is taken out from the bath, washed and dried.

Example 3

A method of making a grinding pin, wherein the initial abrasive material consists of diamond particles, and the abrasive material of reduced grain size is alexite.

In an electrolytic tank filled with a nickel plating bath for the grinding pin, diamond particles having a size of 63/50 micrometers, and nickel anodes are placed. On the working surface of the tool and around the grain which adjoins the said surface a coat of the metal binding material having a thickness of about $\frac{1}{3}$ of the particle size is deposited. Then, after a lapse of 2 hours the abrasive material is changed to alexite having a particle size of 5 micrometers, and further depositing of the coat of the binding material is carried out during 1 hour at a current density of 100 $A/m^2$, and then the tool is taken out from the bath, washed and dried.

What is claimed is:

1. In a method of manufacturing an abrasive tool comprising electrolytically depositing a layer of metal binding material together with particles of an abrasive material on a tool, the improvement wherein the abrasive material initially comprises larger particles having a particle size of from 63/50 to 200/160 micrometers and subsequently comprises smaller particles having a particle size smaller by at least one order of magnitude than the particle size of the larger particles, and wherein the time of depositing the metal binding material and the larger particles is at least half of the total time of applying the metal binding material.

2. The method according to claim 1, wherein the smaller particles have a particle size smaller by at least two orders of magnitude than the particle size of the larger particles.

3. The method according to claim 1 or 2 wherein the larger particles are selected from the group consisting of diamond and cubic boron nitride particles and the smaller particles are particles of silicon carbide having a particle size of from 0.5 to 5 micrometers.

4. The method according to claim 1 or 2 wherein the larger particles are selected from the group consisting of diamond and cubic boron nitride particles and the smaller particles are particles of diamond microgrit having a particle size of from 0.1 to 20 micrometers.

5. The method according to claim 1 or 2 wherein the larger particles are selected from the group consisting of diamond and cubic boron nitride particles and the smaller particles are particles of aloxite having a particle size of from 1 to 6 micrometers.

6. The method according to claim 1 or 2, wherein the ratio of the time of depositing the metal binding material and the smaller particles to the total time of depositing the metal binding material decreases as the size of the larger particles increases.

* * * * *